US006684853B1

(12) United States Patent
Lei

(10) Patent No.: US 6,684,853 B1
(45) Date of Patent: Feb. 3, 2004

(54) FUEL INJECTOR WITH DIRECT NEEDLE VALVE CONTROL

(75) Inventor: Ning Lei, Addison, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 09/365,965

(22) Filed: Aug. 2, 1999

Related U.S. Application Data

(60) Provisional application No. 60/104,662, filed on Oct. 16, 1998.

(51) Int. Cl.[7] ..... F02M 37/04

(52) U.S. Cl. ..... 123/446; 123/300; 123/496

(58) Field of Search ..... 123/446, 447, 123/500, 501, 300, 502, 299, 496, 467

(56) References Cited

U.S. PATENT DOCUMENTS 4,173,208 A 11/1979 Fenee et al.
4,440,132 A 4/1984 Terada et al.

(List continued on next page.)

FOREIGN PATENT DOCUMENTS

DE 4118237 A1 12/1991

OTHER PUBLICATIONS

"The Sturman Injector"; 1 page illustration of an injector allegedly invented by Oded Sturman as early as May 1993 according to publicly available documents in Cause No. 99–CV–1201 currently pending in the federal district court for the Central District of Illinois.

S.F. Glassey, A.R. Stockner, M.A. Flinn, Caterpillar, Inc., Heui–A New Direction for Diesel Engine FUel Systems, 93270, pp. 1 to 11.

(List continued on next page.)

*Primary Examiner*—Carl S. Miller
(74) *Attorney, Agent, or Firm*—Dennis Kelly Sullivan; Susan L. Lukasik; Jeffrey P. Calfa

(57) ABSTRACT

A hydraulically-actuated unit fuel injector of the intensifier type is provided with two independently operable active control valves. A selectively actuable fuel pressure control valve is disposed on the hydraulic actuation fluid side to control the fuel pressure actuation process and provide a window of injection opportunity wherein the fuel pressure is maintained at high pressure. A selectively actuable timing control valve is disposed on the high pressure fuel side to provide precise control of injection timing events and duration, such as start of injection, end of injection, timing of interruption and duration of interruption, which all may occur during a single injection event within the window of opportunity. Both control valves are independently controlled to prevent reverse motion of the intensifier piston and plunger during dwell or interruption of injection while maintaining the full injection pressure. Dwell or interruption is controlled by using the timing control valve to port fuel under pressure to a fuel injector needle valve surface to generate a force on the fuel injector needle valve surface acting to close the fuel injector needle valve. Methods of defining a fuel injection event fuel injector having a fuel pressure intensifier, includes the steps of (a) preparing fuel pressure with a fuel injection pressure control valve, and (b) controlling the timing of a fuel injection event with a fuel injection timing control valve, the fuel pressure preparation and the timing of the fuel inject event being independently controllable. Preferably, full intensified fuel pressure is made available to the injector throughout a single injection event which may include a pilot injection, a main injection, a rate-shaped injection, and dwell periods wherein no injection occurs. Various methods of operating the fuel injector to provide various functions during a single injection event are also disclosed.

73 Claims, 7 Drawing Sheets

U.S. PATENT DOCUMENTS

| | | | | | |
|---|---|---|---|---|---|
| 5,181,494 | A | | 1/1993 | Ausman et al. | |
| 5,460,329 | A | | 10/1995 | Sturman | |
| 5,463,996 | A | | 11/1995 | Maley et al. | |
| 5,535,723 | A | | 7/1996 | Gibson et al. | |
| 5,551,398 | A | | 9/1996 | Gibson et al. | |
| 5,622,152 | A | * | 4/1997 | Ishida | 123/467 |
| 5,628,293 | A | | 5/1997 | Gibson et al. | |
| 5,651,345 | A | | 7/1997 | Miller et al. | |
| 5,669,355 | A | | 9/1997 | Gibson et al. | |
| 5,673,669 | A | | 10/1997 | Maley et al. | |
| 5,682,858 | A | | 11/1997 | Chen et al. | |
| 5,685,490 | A | | 11/1997 | Ausman | |
| 5,697,342 | A | | 12/1997 | Anderson et al. | |
| 5,709,341 | A | | 1/1998 | Graves | |
| 5,738,075 | A | | 4/1998 | Chen et al. | |
| 5,752,659 | A | | 5/1998 | Moncelle | |
| 5,862,792 | A | * | 1/1999 | Paul | 123/446 |
| 5,878,720 | A | | 3/1999 | Anderson et al. | |
| 5,893,350 | A | * | 4/1999 | Timms | 123/467 |
| 5,893,516 | A | | 4/1999 | Harcombe et al. | |
| 5,901,685 | A | * | 5/1999 | Noyce | 123/467 |
| 5,913,300 | A | * | 6/1999 | Drummond | 123/467 |
| 5,931,139 | A | | 8/1999 | Mack | |
| 5,954,030 | A | | 9/1999 | Sturman et al. | |
| 5,975,437 | A | | 11/1999 | Streicher et al. | |
| 5,979,415 | A | * | 11/1999 | Sparks | 123/446 |
| 5,986,871 | A | | 11/1999 | Forck et al. | |
| 6,024,296 | A | | 2/2000 | Wear et al. | |

OTHER PUBLICATIONS

W.Boehner, K.Hummel, Common Rail Injection System for Commercial Diesel Vehicles, 970345, pp. 133 to 141.

N.Guerrassi, P.Dupraz, A Common Rail Injection System for High Speed Direct Injection Diesel Engines, 980803, pp. 13 to 20.

M.Osenga, CAT Gears Up Next Generation Fuel Systems, North American Edition, Diesel Progress, Aug. 1998, pp. 82 to 90.

C.Cole, O.E.Sturman, D.Giordano, Sturman Industries, Inc., Application of Digital Valve Technology to Diesel Fuel Injection, 1999–01–0196, pp. 1 to 7.

* cited by examiner

VALVE 1 – INJECTION CONTROL VALVE
VALVE 2 – TIMING CONTROL VALVE
ROI – RATE OF INJECTION

FUEL INJECTOR WITH DIRECT NEEDLE VALVE CONTROL

RELATED APPLICATION

This application claims the benefit of U.S. Provisional Application Serial No. 60/104,662, filed Oct. 16, 1998 incorporated herein in its entirety by reference.

BACKGROUND OF THE INVENTION

This invention is related to the fuel supply for internal combustion engines and, more particularly, to a fuel injector having two active control valves to control needle valve motion. One control valve is used to control the injection pressure process. The second control valve is used to directly control the fuel injector needle valve. Depending on the coordination between two control valves, different injection characteristics are obtained as desired.

THE PRIOR ART

A hydraulically-actuated, electronically-controlled, unit injector (HEUI), of the type described in U.S. Pat. No. 5,181,494 and in SAE Technical Paper Series 930270, *HEUI—A New Direction for Diesel Engine Fuel Systems,* S. F Glassey, at al, March 1–5, 1993, which are incorporated herein by reference, is depicted in prior art FIG. 1.

The prior art HEUI 200 is depicted in prior art FIG. 1. HEUI 200 consists of four main components: (1) control valve 202; (2) intensifier 204; (3) nozzle 206; and (4) injector housing 208.

The purpose of the control valve 202 is to initiate and end the injection process. Control valve 202 is comprised of a poppet valve 210, and electric control 212 having an armature and solenoid. High pressure actuating oil is supplied to the lower seat 214 of the valve 210 through oil passageway 216. To begin injection, the solenoid of electric control 212 is energized, moving the poppet valve 210 upward off the lower seat 214 to the upper seat 218. This action admits high pressure oil to the spring cavity 220 and the passage 222 to the intensifier 204. Injection commences and continues until the solenoid of the control 212 is de-energized and the poppet 210 moves from the upper seat 218 to lower seat 214. Oil and fuel pressure decrease as spent actuating oil is ejected from the injector 200 through the open upper seat oil discharge 224 to the valve cover area (not shown) of the internal combustion engine.

The middle segment of the injector 200 is comprised of the hydraulic intensifier piston 236, the plunger 228, the plunger chamber 230, and the plunger return spring 232.

Intensification of the fuel pressure to desired injection pressure levels is accomplished by the ratio of areas between the upper surface 234 of the intensifier piston 236 and the lower surface 238 of the plunger 228. The intensification ratio can be tailored to achieve desired injection characteristics. Injection begins as high pressure actuating oil is supplied to the upper surface 234 of the intensifier piston 236. Fuel is admitted to the plunger chamber 230 (formed in part by lower surface 238) through passageway 240 past check valve 242.

As the piston 236 and plunger 228 move downward, the pressure of the fuel in plunger chamber 230 below the lower surface 238 of the plunger 228 rises. High pressure fuel flows in passageway 244 past check valve 246 to act upward on needle valve 250. The upward force opens needle valve 250 and fuel is discharged from orifice 252. The piston 236 continues to move downward until the solenoid of the control 212 is de-energized, causing the poppet 210 to return to the lower seat 214, thereby blocking actuating oil flow. Oil pressure above the intensifier piston is now vented to the ambient through drain passage 224. The plunger return spring 232 returns, the piston 236 and plunger 228 to their initial positions. As the plunger 228 returns, the plunger 228 draws replenishing fuel into the plunger chamber 230 across ball check valve 242.

The nozzle 206 is typical of other diesel fuel system nozzles. The valve-closed-orifice style is shown, although a mini-sac version of the tip is also available. Fuel is supplied to the nozzle orifice 252 through internal passages. As fuel pressure increases, the nozzle needle valve 250 is lifted from the lower seat 254 (compressing spring 256), thereby opening the needle valve 250 and causing fuel injection to occur. As fuel pressure decreases at the end of injection, the spring 256 returns the needle valve 250 to its closed position on the lower seat 254.

The HEUI Intensifier System

For all unit injectors in production today, there is only one active control valve in each injector. Fuel injectors are typically of the common rail or intensifier types. The common rail type (Lucas and Bosch type systems) has a very high pressure fuel rail that supplies fuel to the injector at a pressure ready for injection, on the order of 20,000 psi. The intensifier injector (HEUI type) includes an intensifier plunger in the injector itself to bring low supply fuel pressure to a desired injection pressure level internally. This process is as described above.

One of very desired characteristics of the HEUI intensifier system is its similarity in performance to the Bosch type pump and nozzle injection system (cam system), where injection pressure is gradually built up during an injection event. This gradual building up process produces a generally triangle shaped rate-of-injection single shot injection event where the initial portion of the injection pressure rate trace rises gradually, as distinct from a sharp rising. See FIG. 3, case 4. This type of injection rate trace provides a benefit to reduce NOx emissions at high speed engine operation. This is a very special feature of the intensifier system. Common rail systems can not produce this feature.

In the HEUI injector concept shown in U.S. Pat. No. 5,460,329, pilot injection is produced through double action of a single spool digital control valve. The result is similar to the solid line injection event depicted in FIG. 3, case 1. The entire injection event, having a pilot injection event preceding a main injection event, is considered as two independent, pulse-width-controlled, single injection events occurring in very close sequence. The pilot portion of injection is a single shot of injection but with very short pulse width. With this philosophy, the intensifier chamber pressure is vented to terminate the pilot injection at the end of the pilot injection event and recharged again to start the main injection.

The HEUI B injector, described in U.S. Pat. No. 5,682,858, improves its performance by using direct control of the needle valve. However, the intensifier is also passively controlled by the same control valve. The actuation process is not totally independent of needle timing control. This type of injector cannot have fully flexible injection timing and rate shaping control across the whole engine speed and load range. It may have difficulty producing certain dwell and certain pilot injection size when the actuation pressure is mismatched. Another desirable characteristic of the intensifier system is its product safety. High injection pressure is developed within the injector only during a short period during the engine cycle, only during the time window where injection events are going to occur, as distinct from a high pressure common rail system. The injector stays in a low pressure environment for the rest of the engine cycle. Additionally, there is no external plumbing required to transport fuel from a high pressure pump to the injector as in the common rail system. Compared to the common rail system, the intensifier system demonstrates a much superior advantage that appeals to a large number of engine manufacturers.

Common Rail Systems (Lucas & Bosch Type Systems)

The common rail fuel system is very different from the previously described injectors that incorporate an intensifier system. In the common rail system, the injector is not responsible for the injection pressure development process. Rather, the high pressure fuel, on the order of 20,000 psi is delivered to the injector from the common rail ready for injection into the combustion chamber of an engine. The injector has direct timing control of the injector needle valve with a relatively simple timing control process to produce the desired pilot injection and injection event dwell (duration). Injection timing and duration are purely a timing issue. In any unit injection system, the speed of control valve response is considered as the most crucial element and the limiting factor for achieving small pilot and small dwell size especially under high engine speed and high injection pressure operation conditions. Using one control valve to handle both pressure and timing, as in the intensifier system, can be very challenging and limiting. Thus, decoupling the pressure development process from the timing control process becomes a necessary step to further improve injection system performance in the future. The common rail system by its nature is decoupled, being responsible only for timing. For this reason, the common rail system has much superior control of the pilot size and dwell duration due to its direct needle control and independent fuel pressure control outside of the injector as compared to the intensifier system.

Both the Lucas and the Bosch type unit injectors have only one active control valve on each injector. For both of them, the single control valve is used to directly control the timing of the needle valve opening and closing. The sole function of the control valve in a common rail system is control of the timing of injection events (e.g., starting, ending and duration of the injection).

Timing control of the fuel injector is highly dependent on the response time of the control valve. For this reason, the Lucas type system apparently has better response than the Bosch type system due to its faster response of the control valve.

SUMMARY OF THE INVENTION

The present invention injector has the advantages of both the intensifier system and the common rail system, while substantially avoiding the problems of the two systems as indicated below.

(1) Decoupling The Injection Pressure Preparation From Timing Control, Without Going To A High Pressure Common Rail.

This is achieved by having two active control valves in one unit injector of the intensifier type. One control valve (the pressure control valve) is on the actuation liquid side and other control valve (the timing control valve) is on the high pressure fuel side. In order to maintain the advantages of the intensifier system, the pressure control valve is used to control the pressure actuation process. The pressure control valve is responsible for opening up the window of injection opportunity. The timing control valve is responsible for controlling when and how long the injection event takes place within the window of opportunity. This two control valve system is the marriage between the intensifier system and the common rail system. The present invention keeps the advantages of both systems (intensifier and common rail) and provides the opportunity to eliminate the undesired characteristics of each of the systems alone. Since the injector of the present invention has two active control valves, coordination of the control schedule between two valves can produce markedly different and desirable injection characteristics. More particularly, the pressure control valve is used to define the window of operation during which the actuation pressure will be used. The timing control valve is responsible within the window for the precise control of injection timing events and duration, such as start of injection, end of injection, timing of interruption and duration of interruption.

(2) The Pilot Injection Process Of The Present Invention Is Accomplished By Controlled Interruption Of A Normal Injection Event.

With the present invention, an injection event, including pilot injection and/or rate shaping, is considered as a single shot injection event, but with a certain duration of interruption. The duration of interruption (dwell) is effected by the timing control valve and is the consequence of dwell. When the interruption (dwell) is short, it results in a rate shaping injection. See FIG. 3, case 5 and FIG. 4, case 5. When the interruption is long, it causes split or pilot injection. See FIG. 3, case 1 and FIG. 4, case 3. Without any interruption, the injection is a normal single shot. See FIG. 3, case 4 and FIG. 4, case 1. But with interruption, depending on the duration of interruption (dwell), the injection flow curve can be formed to provide rate shaping, split injection, pilot injection and more injection segments as needed. This controlled interruption to a normal injection event can happen any time during the injection event as long as actuation pressure or injection pressure exists.

(3) Independent Control Of Pilot Injection And Main Injection Within A Single Shot Injection Event.

All present unit injection systems need to achieve pilot injection and main injection by generating two independent single shot injection events. For example, the injection system described in U.S. Pat. No. 5,460,329 requires the decay of actuation pressure to define between the pilot and main injection events. In the prior art, this may be accomplished by reversal of the motion of the intensifier. Such reversal has the disadvantage of diminishing the injection pressure in the fuel injector. Once the injection pressure is developed in the fuel injector during an injection event, the injection pressure should not be destroyed for the purpose of pilot injection pressure, if possible. The total time allowed for injection to occur is too short to waste in diminishing and rebuilding injection pressure. Therefore, the concept of the present invention is to emphasize no reverse motion of the intensifier piston and plunger during pilot injection, thereby maintaining injection pressure. Dwell in the pilot injection is caused by closing the needle valve rather than by reducing or eliminating the injection pressure. The timing control valve of the present invention is used to spill part of the high pressure fuel to the back of the needle valve to force needle valve closing. This closing creates the separate pilot and main injection events while maintaining injection pressure in the injector.

(4) The Present Invention Improves The Digital Control Valve HEUI Injection System (U.S. Pat. No. 5,460,329), Making It More Efficient In Main Injection Pressure And Shorter In Duration.

This improvement is achieved in the present invention by having main injection occur under maximum injection pressure situation. Maximum injection pressure is obtained by having the full actuation pressure level acting on the intensifier piston at all times during the injection event. The intensifier chamber pressure is maintained at maximum actuation pressure, since the pressure control valve stays open all the time throughout the injection event, i.e., the plunger chamber fuel pressure then is maintained at maximum intensified level. There is no double action of the pressure control valve as in the past.

(5) Improved Response In Shaping The Injection Event As Desired.

In the present invention, the pressure control valve is much larger (in terms of flow area) than the timing control valve and is therefore much less responsive than the timing control valve. This is because the flow; rate of actuation liquid is about seven times more than the fuel injection flow rate. Therefore, with the concept of the present invention, the large pressure control valve is only operated once per injection event while the small timing control valve can be operated multiple times if needed during an injection event in order to effect the desired rate-of-injection shape. This is evident in reviewing the valve positions depicted in cases 1–5 of FIG. 4. The relatively small timing control valve has much better response than the relatively larger pressure control valve.

(6) More Varied Injection Characteristics Are Achieved With The Two Active Control Valves Of The Present Invention In One Unit Injector Of The Intensifier Type Than Can Be Achieved With A Single Control Valve.

No present fuel injection system is able to generate all the noted flexible injection characteristics without introducing significant variability from injection event to injection event and deterioration of performance. Most production injectors can only do some of the features listed in FIG. 3. All of the FIG. 3 features are attainable by the present invention. It is highly desirable that a unit injector be able to do all of these features in order to meet high emission standards, reduced noise, and improved drivability.

The present invention includes a needle valve controller for use in a fuel injector to control the opening and closing of a fuel injector needle valve, including a selectively actuatable timing control valve being in flow communication with a source of fuel under pressure and being in flow communication with a fuel injector needle valve surface, the valve being shiftable between an open and a closed disposition. A controller is operably coupled to the timing control valve for controlling the shifting of the timing control valve between the valve open and closed dispositions, opening of the timing control valve acting to port fuel under pressure to the fuel injector needle valve surface, the fuel generating a force on the fuel injector needle valve surface acting to close the fuel injector needle valve.

The present invention is further a method of defining a fuel injection event in a fuel injector having a fuel pressure intensifier, including the steps of (a) preparing fuel pressure with a fuel injection pressure control valve, and (b) controlling the timing of a fuel injection event with a fuel injection timing control valve, the fuel pressure preparation and the timing of the fuel inject event being independently controllable.

DETAILED DESCRIPTION OF THE PREFERRED EMBODIMENT

Figure 1:
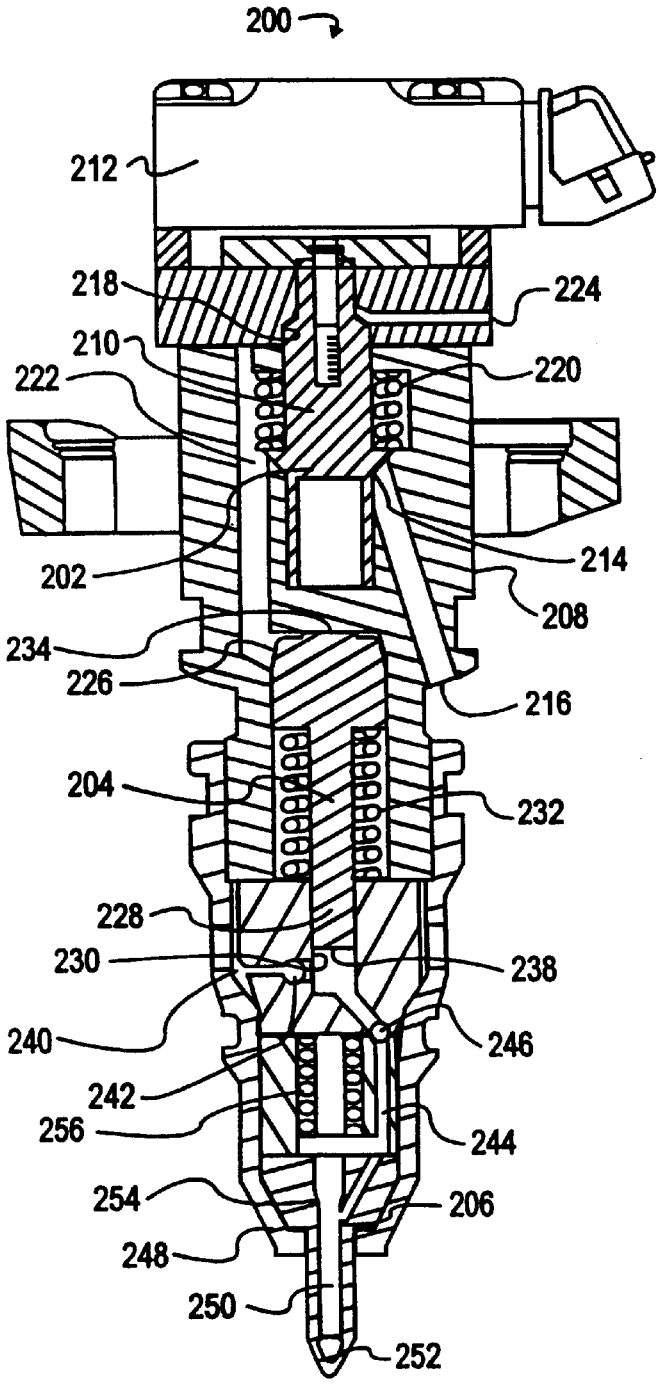
FIG. 1 PRIOR ART
FIG. 1 is a sectional side view of the prior art HEUI injector.
Figure 2:
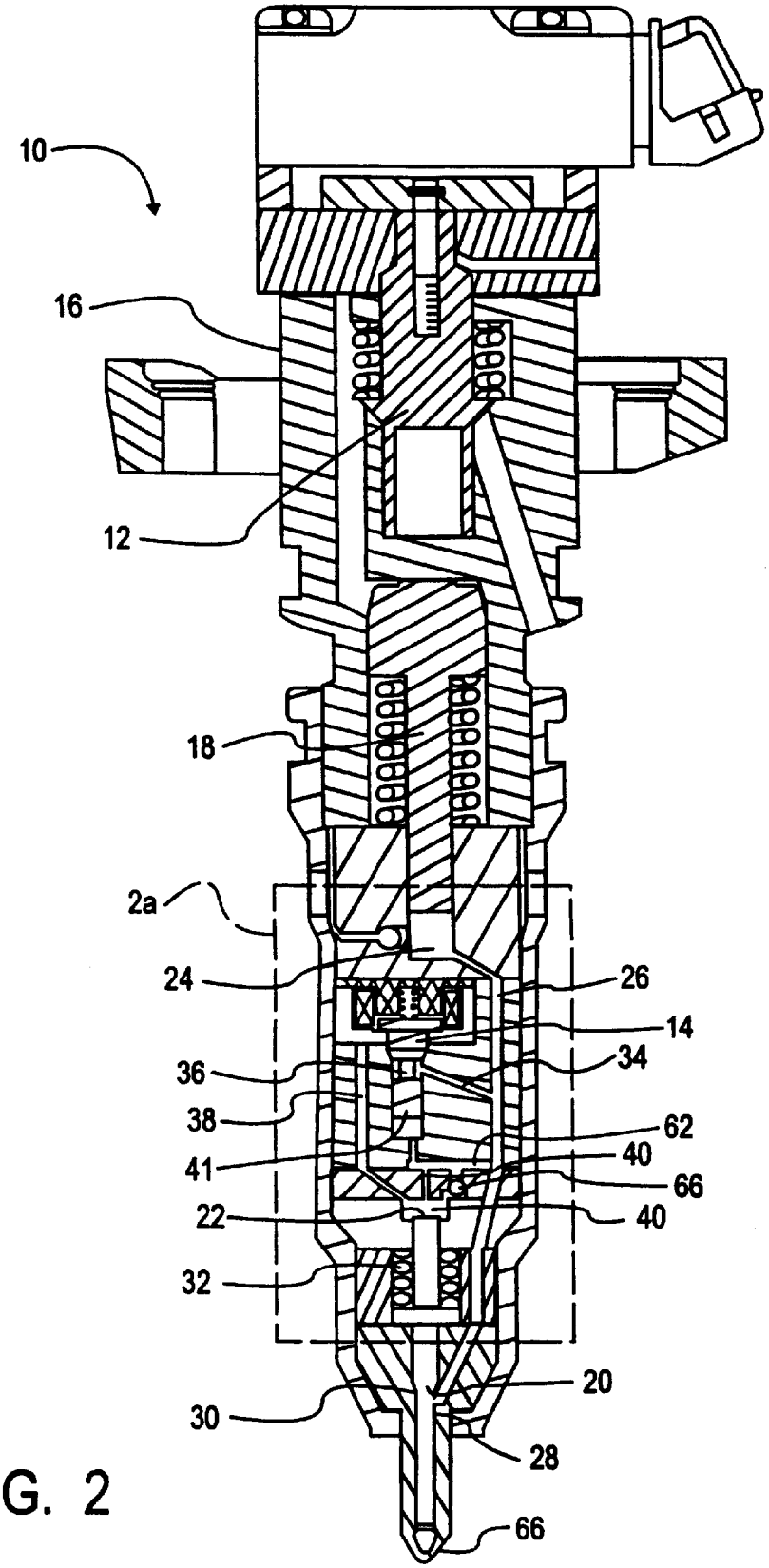
FIG. 2 is a sectional side view of a HEUI-type injector with the needle valve control of the present invention.

FIG. 2 shows the injector 10 of the present invention. The HEUI injector 200 is used as the baseline injector, as depicted in prior art FIG. 1, and has been modified to incorporate the present invention. Other intensifier type injectors may be utilized to incorporate the present invention. The injector 10 of the present invention has two active control valves. The first control valve (the pressure control valve 12) is on the actuation liquid side and the second control valve (the timing control valve 14) is on the high pressure fuel side.

The injector body 16 contains the injection pressure control valve 12, a pressure intensifier 18, the timing control valve 14, and a spring loaded conventional needle valve 20 disposed in the injector tip housing 21 of the injector 10. The timing control valve 14 and associated fluid passageways (as will be discussed below) of the present invention are included for direct hydraulic control of the needle valve 20. As will be described in more detail below, the basic function of the timing control valve 14 is to pass high pressure fuel to the needle valve control surface 22 of the needle valve 20. Such fuel acts on the needle valve control surface 22 to accurately, directly, and hydraulically control the opening and closing motions of the needle valve 20 as desired to effect desired injection characteristics.

There are two flow passageways from the bottom of the plunger chamber 24 to needle valve 20. High pressure fuel passageway 26 is conventionally connected to the nozzle chamber 28 where the needle front area 30, formed by an increased diameter of the needle valve 20, is exposed to the fuel pressure. Fuel pressure generated in the chamber 28 acts upwardly on the front area 30 to open the needle valve 20 by opposing the closing bias of the needle valve spring 32.

The first bleed off passageway 34 is fluidly coupled to the spool 36 of the timing control valve 14. A second bleed off passageway 38 is fluidly coupled to the spool 36 and is further fluidly coupled to a chamber 40 defined in part by the needle valve control surface 22 of the needle valve 20. In a preferred embodiment, surface 22 is a top margin at the back of the needle valve 20.

Figure 2A:
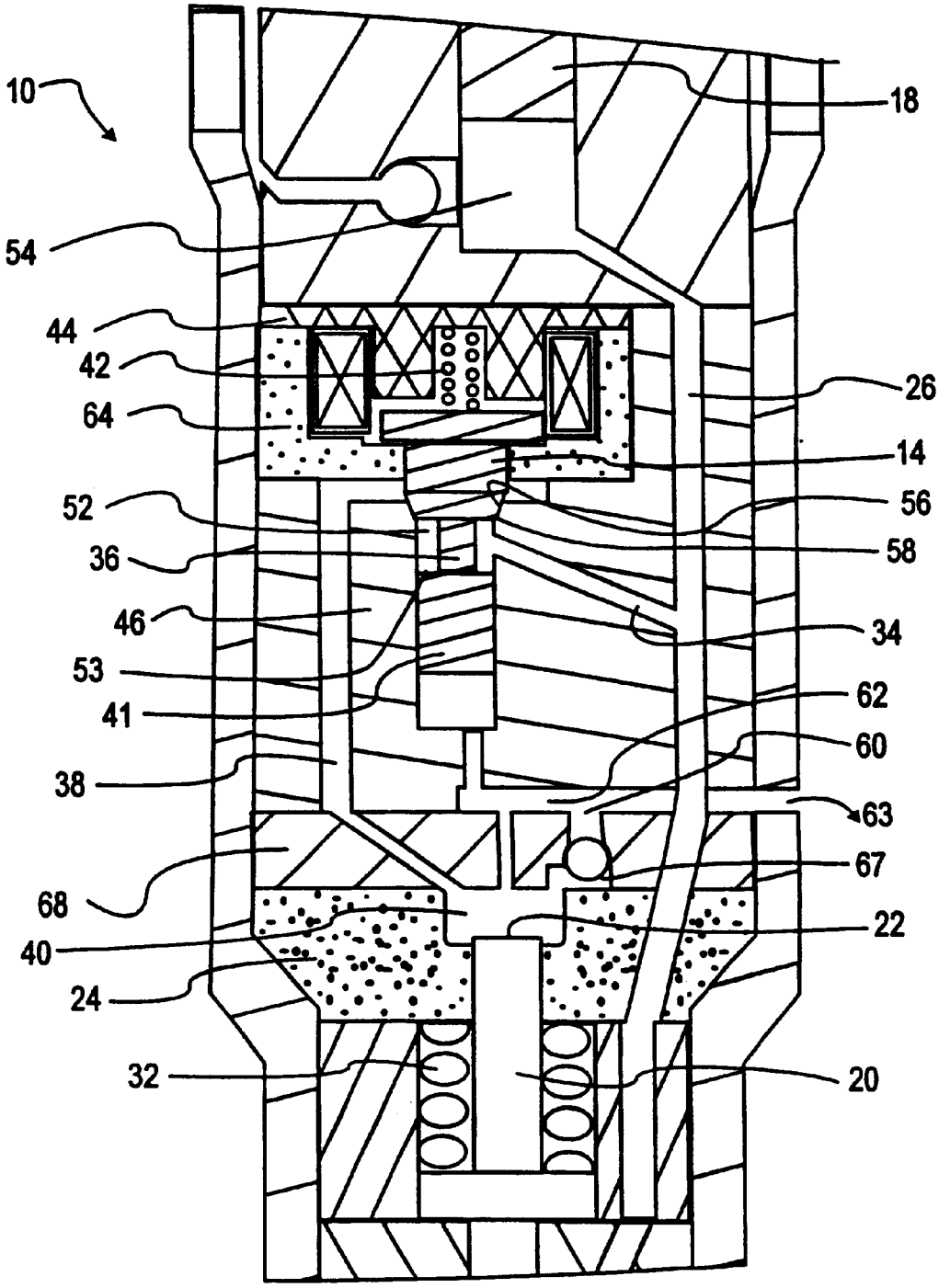
FIG. 2*a* is an enlarged depiction of the area 2*a* of FIG. 2 in the closed disposition.
Figure 2B:
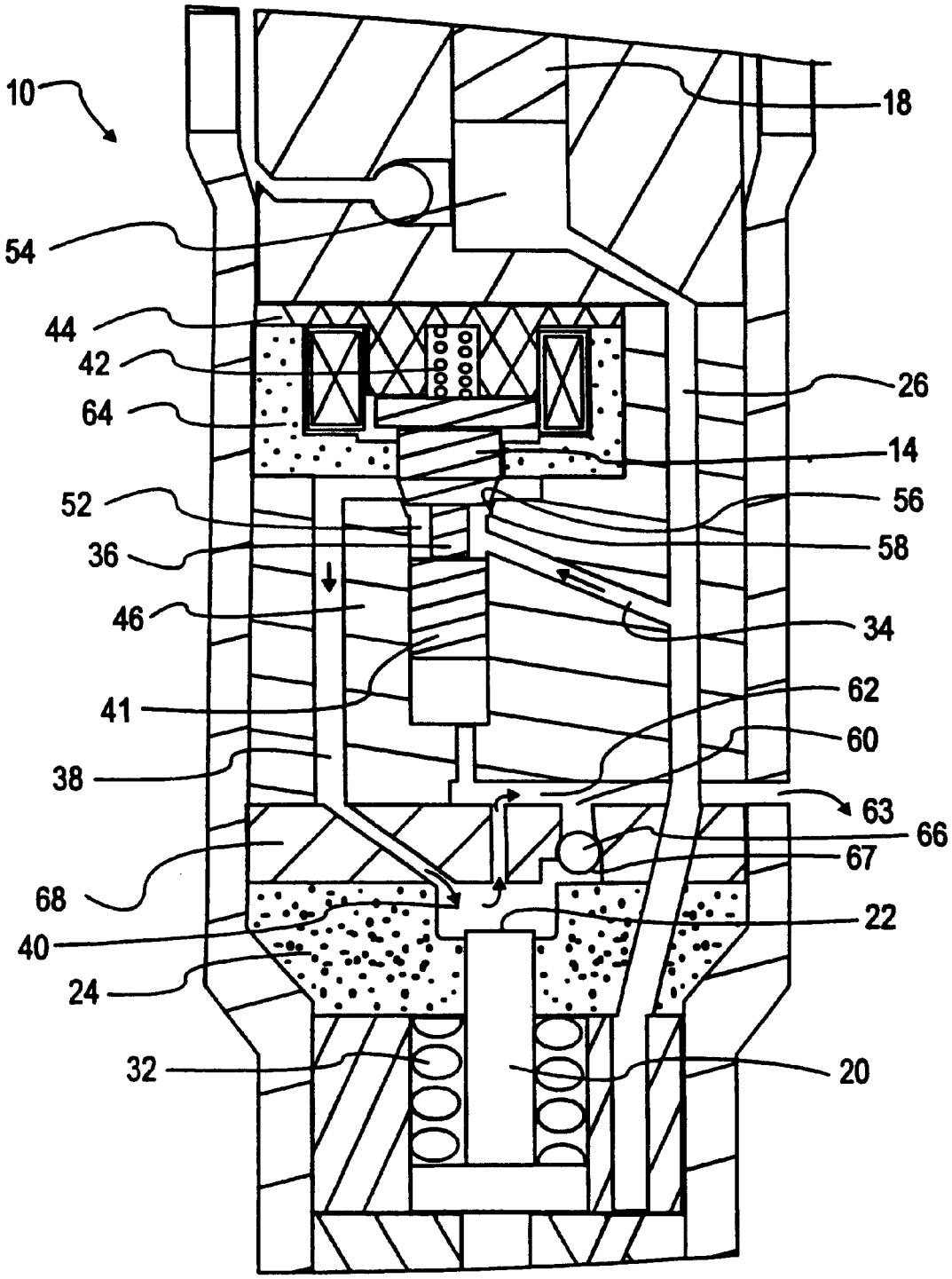
FIG. 2*b* is an enlarged depiction of FIG. 2*a* in the open disposition.

FIGS. 2*a* and 2*b* show the enlarged timing control valve 14 and the relation to the high pressure fuel passage 26. The timing control valve 14 includes a coil spring 42, an end cap 44, a valve body 36, and the valve housing 46. Leakage between the timing valve body 36 and the housing 46 is preferably controlled to a minimum. There is a spool groove 52 on the valve body 36 which defines in part the spool chamber 53. The spool chamber 53 provides flow communication between the intensifier chamber 54 to the chamber 40 at the needle back when the control valve 14 is in the open position. A sealing portion 41 of the valve body 36 depends from the groove 52.

The timing control valve 14 is a simple open(on)/closed (off) two position valve, FIG. 2*b* being a depiction of the open(on) configuration of the timing control valve 14 and FIG. 2*a* being a depiction of the closed(off) configuration of the timing control valve 14.

When the timing control valve 14 is at its off position (FIG. 2*a*), chamfered valve face 56 is seated on the valve seat 58 and fuel flow through the spool chamber 53 from the first bleed off passageway 34 to the second bleed off passageway 38 is blocked. The fuel flow to the chamber 40 via second bleed off passageway 38 at the back of the needle valve 20 is accordingly also blocked. The chamber 40 is vented to an external low pressure fuel reservoir 63 (depicted schematically in the figures) through the needle back drain orifice 60 and through the drain passageway 62. Drain passageway 62 is preferably in a different plane as the section and is therefor shown in phantom in FIGS. 2*a* and 2*b*. It should be emphasized that the drain passageway 62 is not fluidly coupled to the high pressure fuel passageway 26.

Drain passageway 62 is drained to the fuel reservoir 63 located external to the injector 10. The fuel reservoir 63 is typically at the pressure (about 50 psig) generated by the engine fuel pump. Drain orifice 60 is relatively restrictive, (preferably between 0.1 and 1.0 mm and more preferably less than 0.5 mm in diameter), having a very small cross-sectional area, and is preferably allowed to flow in both directions (to and from the fuel reservoir 63).

A one way ball check valve 66 is placed in a refill passageway 67 extending between the chamber 40 and the drain passage 62 to the fuel reservoir 63. The check valve 66 is controlled by fuel pressure. When pressure in chamber 40 exceeds pressure in passageway 62, check valve 66 is seated against valve seat 67. Accordingly, fuel flow through check ball 66 is blocked when the chamber 40 is pressurized by the high pressure fuel admitted by the timing control valve 14 and is also blocked during the opening motion of the needle valve 20. The check valve 66 permits sufficient refilling of fuel (at 50 psi) from the fuel reservoir 63 to the chamber 40 to accommodate the volume change in chamber 40 which occurs during the closing motion of the needle valve 20.

The injector 10 acts just like the prior art HEUI injector 200 when the timing control valve 14 is in the closed configuration as described in FIG. 2*a*. Such action is noted above in the background section.

Opening of the timing control valve 14 is effected by a solenoid 64. When the current is supplied to the solenoid 64, the timing control valve 14 moves upward against the spring load of the timing valve spring 42 to the full open position of the timing control valve 14. See FIG. 2*b*. In this open position, the high pressure fuel passage 26 is fluidly connected to the second bleed off passageway 38 through the spool chamber 53 defined by the spool groove 52. High pressure fuel is bled off from plunger bottom chamber 54 to the chamber 40 at the back of the needle valve 20. In this open position, bleed passageways 34, 38 are fully open and the chamber 40 is pressurized. The pressure acts on the surface 22 in conjunction with spring 32 to prevent upward, opening motion of the needle valve 20 or to close the needle valve 20 if the needle valve 20 is open at the time that the timing control valve 14 is opened. Therefore, the needle valve 20 is in the closed position when the timing control valve 14 is in the open position. If the timing control valve 14 stays in the open position for some period of time during an injection event, a measurable duration of the needle valve 20 being closed after injection event initiation is obtained. The needle valve 20 closing duration may be equal to the dwell of the pilot injection event.

The drain orifice 60 is open all the time, but the drain orifice 60 has a very small flow area in order to throttle down fuel flow through the drain orifice 60. Therefore, when high pressure fuel flows into the chamber 40, sufficient pressure is trapped in the chamber 40 to cause needle valve 20 closing by the fuel pressure generating a force acting on surface 22 of the needle valve 20 (in conjunction with spring 32). A constant through-flow occurs at the orifice 60 when timing control valve 14 is in the open position (FIG. 2*b*). (This is very similar to the common rail type system, in which constant leakage of high pressure fuel occurs during the whole injection process.) During a regular single shot injection, the timing control valve 14 is never used and the drain orifice 60 slows down lifting of the needle valve 20 slightly due to the restriction of the drain orifice 60 in permitting fuel to escape from the chamber 40 to the fuel reservoir.

Bleeding off high pressure fuel to the chamber 40 by opening timing control valve 14 causes the needle valve 20 to close if the needle valve 20 is in an open condition. If the timing control valve 14 is open at the very beginning of the injection event (the condition where the intensifier plunger 18 is just about to move downward to increase the fuel pressure), the needle valve 20 will stay in a closed position regardless of what happens to the injection pressure due to the fuel pressure generating the force acting on the surface 22 of the needle valve 20. This can cause a delayed start of injection into the combustion chamber, as desired.

With this strategy, the user can selectively choose the starting condition of each injection event since needle valve 20 opening pressure is controlled by the timing control valve 14. If the timing control valve 14 is opened after injection has already started, an interrupted injection event occurs due to a sudden closing of the needle valve 20. The sudden closing of the needle valve 20 is effected by the opening of the timing control valve 14 to port high pressure fuel to chamber 40. This is pilot injection and results in dwell (a definitive elapsed time occurring) between the pilot injection and the main injection during which no fuel injection is occurring. If the timing control valve 14 is opened at end of the injection event, the timing control valve 14 will cause the needle valve 20 to close even before the pressure control valve 12 is turned off. This produces a sharp end of the injection event, as desired.

The opening/closing of the needle valve 20 is directly controlled by the timing control valve 14. Therefore, this concept is called direct-controlled needle valve and is similar in this regard to a common rail system, having needle valve 20 closing to shape and control the rate of injection, to end pilot injection and form dwell although injection pressure.

Figure 5:
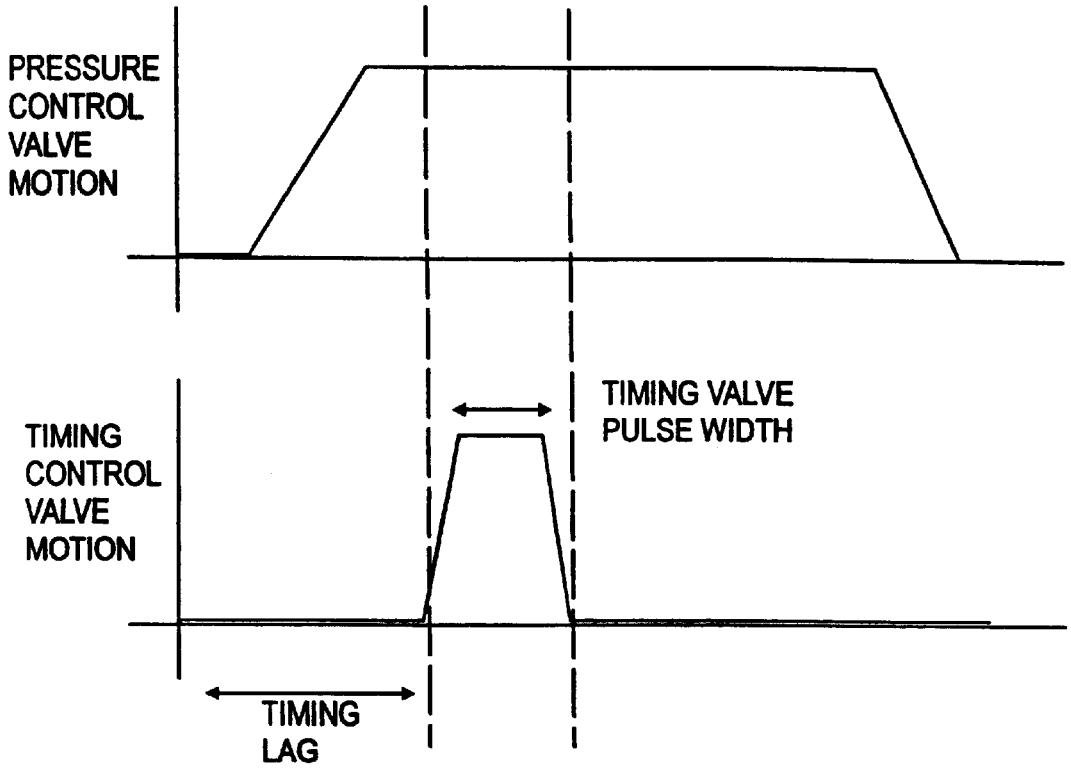
FIG. 5 is a graphic depiction of pilot and dwell control parameters.
Figure 6:
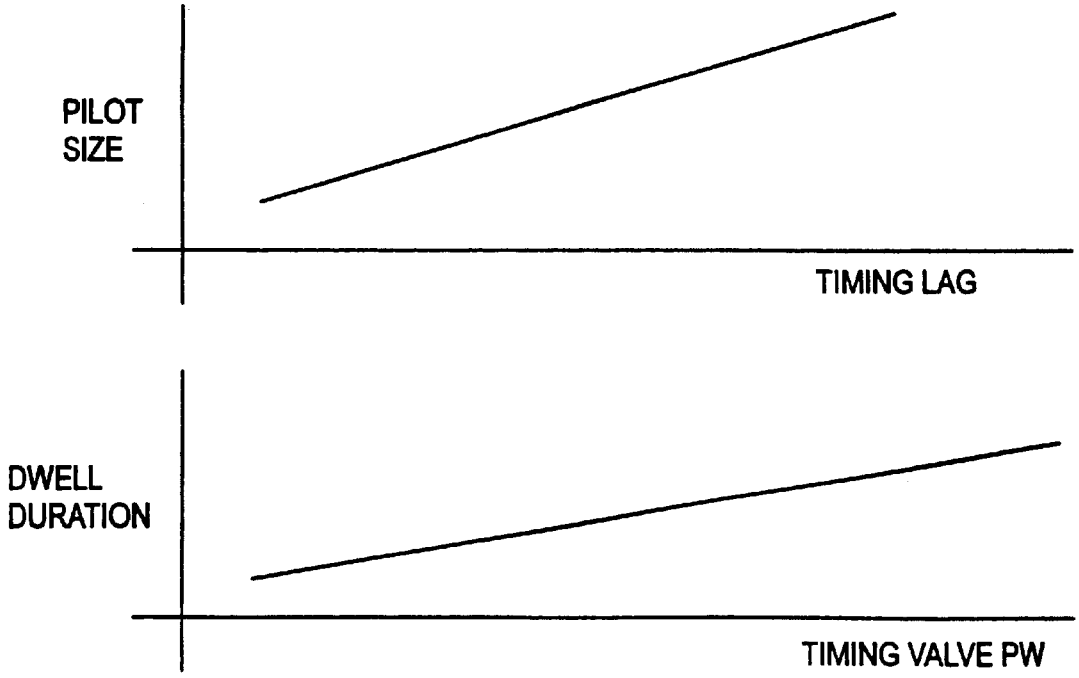
FIG. 6 is a graphic depiction of the performance characteristic.

Referring to FIGS. 5 and 6, during pilot injection, if the timing control valve 14 stays in the open position for a relatively long duration, it produces longer dwell as described above. If the timing control valve 14 stays in the open position for a relatively short duration, a closed pilot injection (no dwell) or rate shaping of the injection event occurs, affecting the shape of the ascending portion of the rate of injection of the injection event.

During the period when the timing control valve 14 is open, the needle valve 20 is closed and the intensifier plunger 18 may continue to move downward due to leakage at the drain orifice 60 from chamber 40 at needle valve 20. The drain orifice 60 is open to the fuel reservoir (approximately 50 psi). Since the drain orifice 60 is very small, the leakage flow from chamber 40 is relatively small. Injection pressure is maintained and the downward compressive motion of the intensifier 18 continues even during temporary shut off of nozzle fuel flow to the combustion chamber from the needle valve 20. This is as a result of the timing control valve 14 being open to exert pressure on surface 22 of needle valve 20. The injection process efficiency is improved by such method of producing dwell by maintaining the injection fuel pressure at a high level throughout the full injection event, instead of decreasing the pressure as a result of reversing the motion of the intensifier 18 in order to shape the rate-of-injection, as in some prior art injectors.

Sizing of the needle drain orifice 60 is very important. The needle drain orifice 60 is open to low fuel pressure (approximately 50 psi) through passageway 62 to the fuel reservoir 63 all the time. With the right size orifice 60, sufficient fuel pressure can be trapped in the chamber 40 to act on surface 22 of the needle valve 20 when high pressure fuel flows from plunger chamber 54 to the chamber 40 as a result of opening the timing control valve 40. The drain orifice 60 allows back pressure in chamber 40 to release slowly when bleed flow into the chamber 40 is stopped. Slow bleed flow at the drain orifice 60 helps to adjust and control the lifting velocity of the needle valve 20 to meet preselected requirements. The size of the drain orifice 60 is very critical to keep the needle valve 20 closed when the timing valve 14 is open, to prevent an excess amount of high pressure fuel from leaking through the drain orifice 60, and to have a slow drain flow at the orifice 60 when the needle valve 20 lifts up again (after fuel pressure bleed off from chamber 40 through orifice 60). The size of the drain orifice 60 is optimized to the needs of the particular injector 10 and the diameter is preferably about 0.1 mm–1.0 mm. In a preferred embodiment, the drain orifice 60 is about 0.5 mm or less. The volume of fuel acting on the surface 22 of the needle valve 14 is partially trapped in the chamber 40 having a volume defined by the needle back 22, the needle housing 24, and check ball plate 68. The needle back surface area 22 is sized properly so that force generated by fuel pressure on the back of the needle valve 20 plus needle spring force exerted by spring 32 is greater than the countering force generated by the high pressure fuel acting on needle front 30. Such force on needle front 30 acts counter to the force of the fuel pressure acting on surface 22 in conjunction with the bias of spring 32. Proper sizing of surface 22 with regard to the surface of needle front 30 and the bias exerted by spring 32 ensures proper closing of the needle valve 20 when the timing control valve 14 is open. This sizing is important since the high pressure fuel is simultaneously to both open and close needle valve 20.

Since the total flow required to the chamber 40 at the needle back is very small, the necessary size of the timing control valve 14 is much smaller than the pressure control valve 12. Further, the travel distance of the timing valve 14 (valve total opening) is also much smaller than the travel (valve total opening) distance of the pressure control valve 12. Therefore, the response of the timing control valve 14 is much faster than the response of the pressure control valve 12.

During the dwell period of a pilot injection event, there is a constant bleeding of high pressure fuel through the needle drain orifice 60. Thus, the intensifier plunger 18 may drift down slowly replenishing fuel in chamber 40 that has been bled from the chamber 40 whenever the timing control valve 14 is in the open configuration. If the timing control valve 14 was open for a duration that is very long, the intensifier plunger 18 could bottom out. This risk is avoided by sizing the stroke of plunger 18 properly, and also by coordinating both the timing control valve 14 on and off schedules properly to avoid an overly long dwell.

Operation

A flexible injection system should have the capability to do single shot injection mode, detached pilot injection mode, attached pilot injection mode, and rate shaped injection mode. The following section describes the operation procedure of the present invention for each different operation modes.

Figure 3:
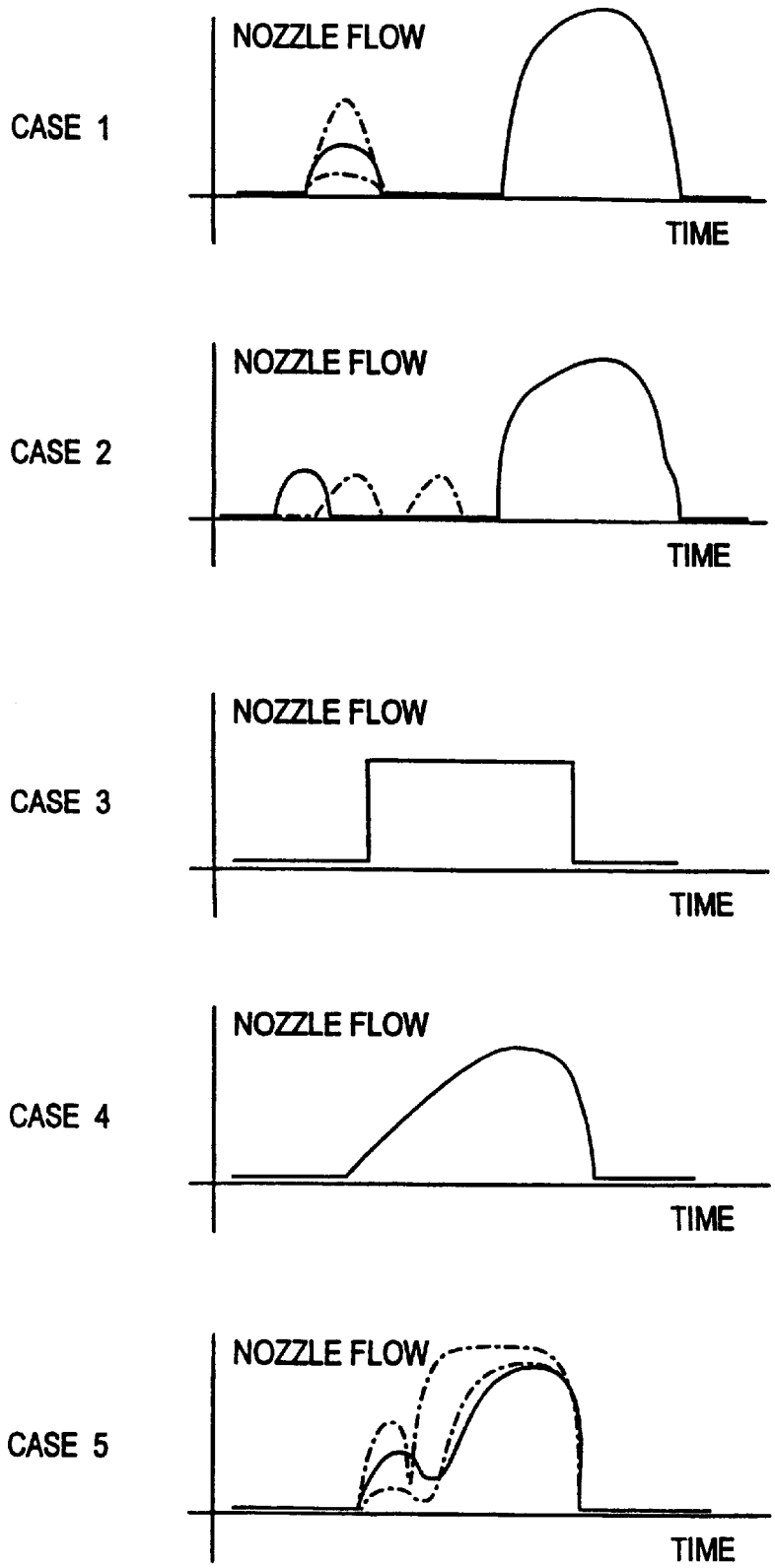
FIG. 3 is a series of graphic depictions of injection features attainable by the present invention.
Figure 4:
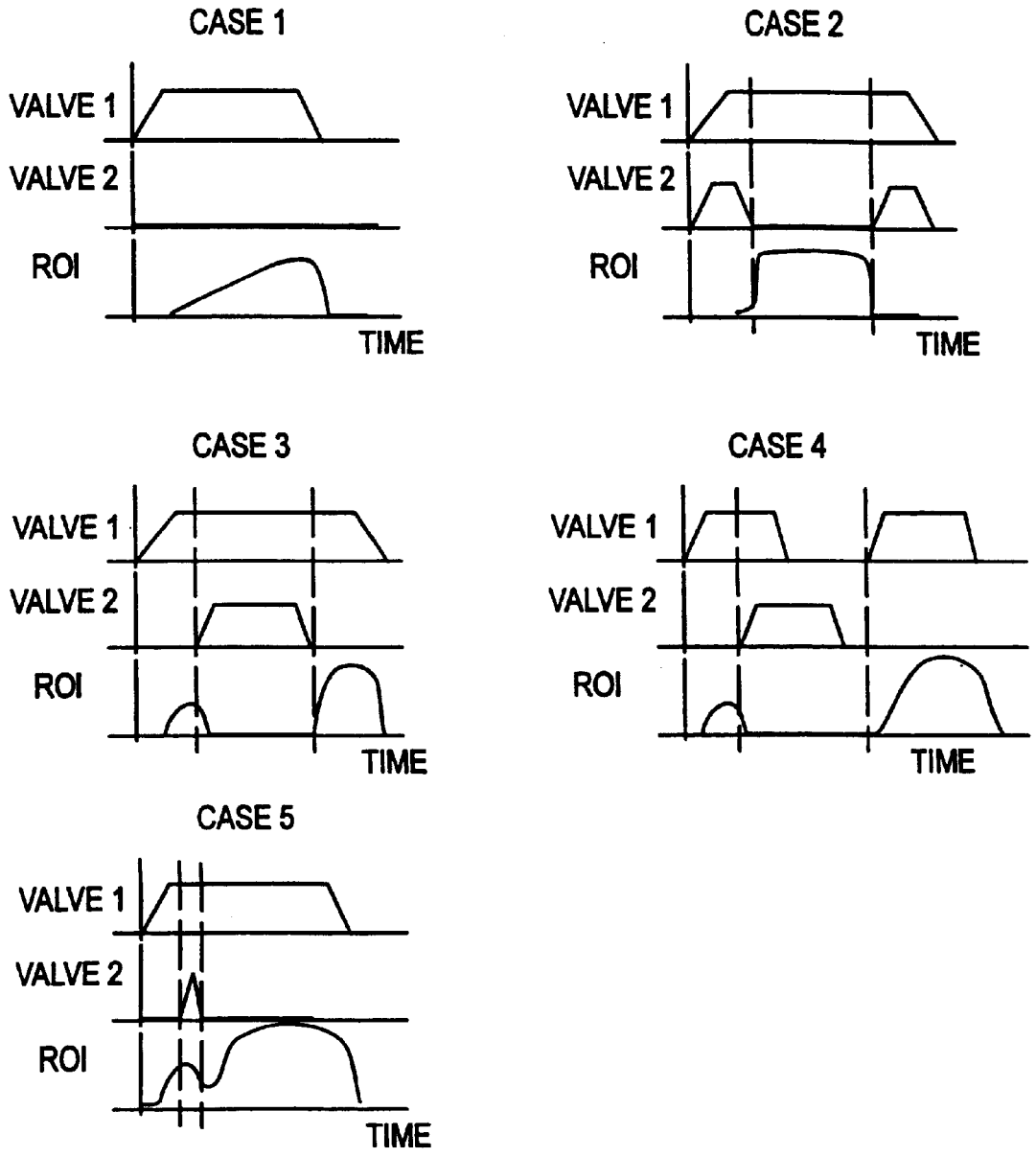
FIG. 4 is a series of graphic depictions of the effects of different coordination between the injection control valve and the timing control valve and the resulting rate of injection.

Single Shot Injection With Triangle or Ramp Shaped Injection (FIG. 4. Case 1: FIG. 3, Case 4)

During single shot ramp injection, the timing control valve 14 stays in the closed position and is never used throughout the injection process. Therefore, high pressure fuel flows only to the front or lower side of the needle valve 20 while the chamber 40 is never pressurized and is vented through drain orifice 60 and passageway 62 to the low fuel pressure reservoir 63. Both timing and injection duration are controlled by the actuating pressure control valve 12. When the pressure control valve 12 is opened, injection pressure builds up gradually in the high pressure fuel passageway 26. The high pressure fuel acts on needle front 30, overcoming the bias of spring 32 and lifting (opening) the needle valve 20. When needle valve 20 opens, injection starts. The resulting single shot injection is substantially the same as a normal prior art HEUI injector 200 injection event as described above in relation to prior art FIG. 1.

Single Shot Injection With Square Fuel Pressure Shape (FIG. 4. Case 2; FIG. 3, Case 3)

Operation of both the control valves 12, 14 is required to achieve a square rate of injection characteristic. The timing control valve 14 is opened ahead of or at the same time that the actuating fluid pressure control valve 12 is opened. A spill and bypass concept is used in this instance to bleed off the initial portion of the fuel pressure buildup resulting from actuation of the actuating pressure control valve 12 to thereby delay the injection starting. Opening the timing control valve 14 results in a spill and bypass through chamber 40, drain orifice 60 and passageway 62 to the low pressure fuel reservoir 63. The initial portion of the injection pressure is relatively low, so injection occurring under this initial portion would cause ramp shaped injection (like single shot ramp injection) if the timing control valve 14 were closed. However, the timing control valve 14 is opened here to bypass these undesired initial pressure conditions and to allow the needle valve 20 to wait to open until the more desirable higher pressure level is attained.

The initial portion of the pressurized fuel is bled off to chamber 40. Because the pressure of the fuel in chamber 40 acts on the surface 22, the force exerted by the fuel pressure in conjunction with the bias exerted by the valve spring 32 acts to keep the needle valve 20 closed. Therefore, the needle valve 20 will stay closed until the timing control valve 14 is returned to the closed position by spring 42 after deactivation of solenoid 64. After a desired period, deactivation of solenoid 64 occurs and valve 14 returns to the closed position. At this time, the injection fuel pressure will have already developed to a very high level. Since the pressure control valve 12 is at fully open position and the intensifier 18 downward velocity has developed, injection occurring under this condition is eruptive and has a very fast rate of injection at the beginning of the injection event. Meanwhile a constant injection pressure is maintained at the plunger chamber 24 by the intensifier 18. This pressure equals the rail pressure of the actuating fluid times the intensification ratio of the intensifier 18. The rail pressure of the actuating fluid may be approximately 3000 psi. The intensification ratio may be seven, resulting in fuel pressure of approximately 21,000 psi.

At the end of injection, the timing control valve 14 is cycled to the open position again by activating solenoid 64 to overcome the closing bias of timing valve spring 42 before the actuating fluid pressure control valve 12 is closed. After opening of timing control valve 14, the fuel pressure of the fuel in chamber 40 again acts on the surface 22. The force exerted by the fuel pressure on the surface 22 in conjunction with the bias exerted by the valve spring 32 acts to forcibly, abruptly close the needle valve 20. Injection flow is nearly instantaneously cut off to zero by this forced closing of the needle valve 20, rather than the more gradual needle valve 20 closing caused by actuation fluid injection pressure decay, as in the prior art. Therefore, the end of injection is also very sharp, resulting in the desired, generally square fuel pressure shape.

Pilot Injection With Reasonable Dwell Duration (FIG. 4, Case 3, FIG. 3, Case 1 (Solid Line))

With the present invention, pilot injection is considered as a single shot injection fully interrupted for a certain duration prior to the main injection, which is also a single shot injection separate from the pilot injection. This interruption is caused by a sudden closing of the needle valve 20 by the timing control valve 14 some time after commencement of the injection event as initiated by the pressure control valve 12. If needle valve 20 closing duration is relatively long, the dwell between pilot injection and main injection will be long. Since both control valves 12, 14 are independently controlled, the on/off schedules of both valves 12, 14 are totally flexible and do not have any interaction and interference with each other. Just as in the case of single shot injection event, in this case the pressure control valve 12 is actuated only once to open the pressure window to the intensifier system 18. The timing control valve 14 is initially closed when the pressure control valve 12 is opened. After the pressure control valve 12 is open, the needle valve 20 opens by lifting upward and injection will start as indicated above in relation to the single shot injection case. The timing valve 14 is then moved to the open position soon after the pressure valve 12 is opened by activation of the solenoid 64. The needle valve 20 then closes again responsive to the timing valve 14 being open, resulting in cessation of the injection. Prior to the closing of the needle valve 20, a small amount of fuel has escaped to the combustion chamber of the cylinder from nozzle hole 66. This produces pilot injection, a very small quantity of injected fuel over a short duration separate in time from the main injection event. The independent pressure control valve 12 remains open and fuel pressure is maintained in a high state.

The size of the pilot injection is clearly the function of the timing lag between the opening of two valves 12, 14. The longer the lag is, the larger the pilot injection volume will be. Since both valves 12, 14 are independently controlled, the pilot injection volume is controlled in a very simple and flexible way. The timing valve 14 may stay open for a while corresponding to the size of the pilot injection dwell duration. At the end of the dwell, the timing valve 14 is turned off again. This results in the opening of the needle valve 20 and the injection event is resumed, providing the main injection event spaced in time from the pilot injection event. The intensifier 18 continues to travel downward in order to provide a continual quantity of high pressure fuel to finish the main injection. The end of injection is accomplished by turning off the pressure control valve 12.

The end of injection can also be achieved by opening the timing control valve 14 to have a forced closing of the needle valve 20 before the pressure control valve 12 turns off. This produces a sharp end of injection as described above in the case of single shot injection with square fuel pressure shape. Thus, the needle valve 20 closes before the decay of injection pressure resulting from closing the pressure control valve 12.

Pilot Injection With Very Long Dwell Duration (FIG. 4, Case 4)

When the dwell duration is extremely long, then pilot injection can be considered as two individual single shots effected by cycling the pressure control valve 12 through two open/close cycles. The pressure control valve 12 is turned on first to start the injection. Since pilot portion has very small total delivery, the timing valve 14 may be used to interrupt the injection commenced by the pressure control valve 12 and to prevent the needle valve 20 from being open too long. After the pilot injection is stopped, the pressure control valve 12 may be turned off to finish the first single shot event. Pressure on top of the intensifier 18 is vented to ambient and the intensifier 18 returns to the top closed position waiting for next injection event. The venting passage (not shown) is conventionally located at top of the poppet valve immediately above the poppet valve spring. To commence main injection, the pressure control valve 12 is opened again and a second injection event starts. Depending on the engine needs, either ramp, single shot, or squared single shot strategy can be used to produce a single shot as the main injection event by appropriate interaction of the timing valve 14 with the pressure valve 12.

Rate-Shaped Injection (FIG. 4, Case 5, FIG. 3, Case 5)

The operation strategy for rate-shaped injection is almost the same as for pilot operation (reasonable dwell case), FIG. 4, case 3. In rate shaped injection events, the timing control valve 14 "on" time is very short, for example, the minimum controllable pulse width of the timing control valve 14. With a very short interruption from the timing control valve 14, the needle valve 20 may not fully return to the closed position during the on time of the timing control valve 14. Injection pressure is only interrupted for a very short period in such case. Therefore, the rate of injection trace will not be split into segments as in FIG. 4, case 3 but will not decay to a zero rate of injection condition. This results in a classic dipped rate-shaped trace.

Depending on the timing control valve 14 schedule, a different rate-shaping trace can be obtained. See FIG. 3, case 5. The rate-shaping injection is considered to be a single shot injection with a very small interruption at an early stage of the injection.

Some Novel Features:

Some of the novel features of the present invention are categorized into two areas: (1) design configuration and (2) injection operation.

(1) Design Configuration

Two active, independently controlled, control valves 12, 14 are used in one unit injector 10. The pressure control valve 12 is on the actuation fluid side to open the pressure window for injection events. Without turning on the pressure control valve 12, there will be no injection pressure, hence no injection, regardless of what happens to the timing control valve 14. The timing control valve 14 is placed on the high pressure fuel side (as distinct from the actuation fluid side) to achieve direct control of the needle valve 20 substantially independent of the pressure control valve 12. Thus, an injection event is stopped or interrupted when the timing control valve 14 is turned on, the timing control valve 14 being on acting to close the needle valve 20. Additionally, because the timing control valve 14 is on the fuel side, continued operation of the intensifier plunger 18 occurs under control of the pressure control valve 12 to ensure a continuous source of high pressure fuel.

(2) Injection Operation

A unit injector 10 with two active control valves 12, 14 does not exist in production today. Therefore, the strategy based on a coordinated schedule of operation of the two control valves 12, 14 is new to the industry.

It is very difficult for a unit injector 10 with a single control valve 12 to produce a variety of injection characteristics (such as those shown in FIG. 3) while still maintaining sufficient controllability, flexibility and simplicity. The control strategy of the present invention presented in the operation procedure section illustrates how two control valves 12, 14 can be coordinated to each other's on/off timing and duration to obtain the varieties of injection characteristics depicted in FIG. 3.

As fuel injection systems are getting more and more sophisticated in terms of operation and control, it becomes more important to design an injector that not only provides excellent performance but also has user friendliness, simplicity and robustness in control strategy. FIGS. 5 and 6 illustrate the relationship between control parameters and performance parameters of the present invention. The injection system of the present invention has two active control valves 12, 14. The valves 12, 14 do not interfere with each other and each valve 12, 14 has very clear responsibility.

FIG. 5 shows the definition of timing lag and timing valve pulse width (PW). Timing lag is the time duration between the start of the pressure control valve pulse width to open the valve and the start of the opening of the timing control valve. Timing lag is an indication of how much later the timing control valve 14 may be actuated on to interrupt the injection event initiated by the pressure control valve 12. Timing lag is also a indication of the pilot injection quantity which will escape from the nozzle before the needle valve is forced to close. Therefore, the pilot injection quantity is linearly related to the timing lag parameter as shown in FIG. 6. The timing control valve 14 pulse width duration is the indication of how long the timing control valve 14 would stay in the open position. Since the timing control valve 14 opening directly causes needle valve 20 closing, the timing control valve 14 pulse width is linearly proportional to the amount of time the needle valve 20 will stay closed. Therefore during pilot injection, dwell is linearly related to the timing control valve 14 pulse width as shown in FIG. 6.

Advantages

A major advantage of the fuel system of the present invention is that it incorporates the advantage of both the intensifier injection system and the common rail injection system. It is a marriage of the two systems, while avoiding some of the disadvantages of each of the two systems.

(1) The injector 10 advantageously does not require high pressure fuel transporting as does the common rail system. High injection pressure is contained within the unit injector. The unit injector 10 is exposed to high pressure operation only during injection event. This is the advantage of the intensifier system.

(2) The injector 10 has direct control of the needle valve 20. This feature is very critical to pilot injection operation. Without direct needle valve 20 control, a small pilot and a small dwell can not be achieved. Direct needle valve 20 control is the advantage of the common rail system as distinct from the intensifier system. This advantage is also kept with the present invention.

(3) Decoupling the actuating fluid pressure control event from the needle timing event as provided for with the present invention makes the whole injection operation much simpler, more flexible and more controllable. Each control valve 12, 14 has its own substantially independent responsibility. The two control valves 12, 14 do not interact and can be controlled independently. This indicates the simplicity of the control strategy. Results can be easily interpolated and extrapolated.

(4) With the present invention, a wide variety of all desired injection characteristics can be readily achieved. No injector in production today is able to achieve all the features. The common rail system cannot achieve ramp injection and rate shaping. The HEUI intensifier system cannot achieve square injection. Pilot size and dwell range are also limited in the prior art.

(5) The philosophy behind this invention is very different from the conventional approach. In this concept, the pilot and rate shaping injections are considered as a single injection interrupted for a short period. Based on this philosophy, each control valve 12, 14 is assigned a sole responsibility coordinated with the other control valve 12, 14. The larger pressure control valve 12 only operates once to perform the single shot injection. The smaller and faster timing control valve 14 can be used many times to control the needle opening and closing during a single open cycle of the pressure control valve 12.

(6) This injector 10 has an intensifier. However, the injector 10 does not require reversal of the intensifier 18 motion to stop pilot injection. This is different from the HEUI-B and digital valve HEUI injection concepts. By avoiding reversal of the intensifier 18 motion, the hydraulic efficiency of the injection is significantly improved, by maintaining high fuel pressure throughout an injection event, even during an injection event having a pilot injection spaced in time from the main injection.

What is claimed is:

1. A fuel injector having a fuel pressure intensifier for increasing the pressure of a volume of fuel to a selected relatively high level, the fuel being admitted to the fuel injector at a pressure that is less than the pressure required to cause opening of an injector needle valve, the fuel intensifier being in fluid communication with the needle valve, the needle valve being openable for injection of fuel into a combustion chamber during an injection event, comprising:

an injection pressure control valve for preparing fuel pressure being fluidly coupled to the fuel pressure intensifier for controlling an injection event by porting a non-fuel actuating fluid to the fuel pressure intensifier; and a fuel injection timing controller having a single control valve for controlling the timing of delivery of fuel to a combustion chamber during the injection event, the fuel injection pressure control valve being independently controllable for maintaining fuel at the selected relatively high level of pressure to the needle valve during the injection event to effect fuel injection and the fuel injection timing control valve for selectively interrupting fuel injection from the needle valve if desired during the injection event by controlling a flow of intensifier pressurized fuel to the needle valve by selectively porting fuel to a controller chamber in fluid communication with the needle valve, the controller chamber having a continuously open drain orifice.

2. The fuel injector of claim 1 wherein the fuel injection pressure control valve opens a window of injection opportunity and the fuel injection timing control valve controls the timing and duration of an injection event that occurs within the window of injection opportunity.

3. The fuel injector of claim 2 wherein the fuel injection pressure control valve opens a window of injection opportunity during which an actuation pressure is made available for use to intensify a fuel pressure.

4. The fuel injector of claim 2 wherein the fuel injection timing control valve controls the timing and duration of an injection event that occurs within the window of injection opportunity to define fuel injection parameters.

5. The fuel injector of claim 4 wherein the fuel injection parameters occurring within an injection event include at least one of the parameters being start of injection, end of injection, interruption of injection, timing of interruption of injection, and duration of interruption of injection, said parameters being attainable while maintaining fuel at the selected relatively high level of pressure to the needle valve.

6. The fuel injector of claim 1 wherein the fuel injection timing control valve provides for selective independent control of pilot injection, main injection and rate shaping within a single shot injection event.

7. The fuel injector of claim 1 wherein fuel injection pressure preparation and fuel injection timing control are internally determined and are decoupled.

8. The fuel injector of claim 1 wherein the fuel injection timing control valve has relatively less flow area in relation to the fuel injection pressure control valve, the lesser flow area enhancing the response time of the fuel injection timing control valve for improving the shaping of the injection event as desired.

9. The fuel injector of claim 1 wherein the fuel injection pressure control valve for preparing fuel pressure is cycled opened and closed a single time during each injection event and the fuel injection timing control valve may be independently cycled opened and closed a plurality of cycles during single time during each injection event for effecting shaping of the injection event as desired while maintaining fuel at the selected relatively high level of pressure to the needle valve.

10. A needle valve controller for use in a fuel injector, the fuel injector having a fuel inlet and a non-fuel actuating fluid inlet, fuel pressure at the inlet being admitted to the fuel injector at a pressure that is less than the pressure required to cause opening of an injector needle valve, the needle valve controller acting in cooperation with an actuating fluid controller disposed in the fuel injector, the actuating fluid controller effecting a known injection rate profile during an injection event by controlling the operation of a fuel intensifier, comprising:

a single selectively actuatable timing control valve being in flow communication with a source of intensifier pressurized fuel and being in flow communication with a fuel injector needle valve surface, the timing control valve being shiftable between an open and a closed disposition; a controller operably coupled to the timing control valve for controlling the shifting of the timing control valve between the valve open and closed dispositions, opening the timing control valve acting to port fuel under pressure to the fuel injector needle valve surface, the fuel generating a force on the fuel injector needle valve surface acting to close the fuel injector needle valve without spilling a high pressure fuel ported to the needle valve for injection therefrom, the shifting of the timing control valve being effected only during those injection events where modification of the known fuel injection rate is desired.

11. The needle valve controller of claim 10, the controller including a solenoid, activation of the solenoid acting to shift the timing control valve to the open disposition.

12. The needle valve controller of claim 11 the controller further including a timing control valve spring, the spring exerting a closing bias on the control valve, the spring urging the control valve to the closed disposition.

13. The needle valve controller of claim 10 wherein flow communication with the fuel injector needle valve surface is via a bleed passageway defined in the fuel injector, the bleed passageway being fluidly coupled at a first end to the timing control valve and being fluidly coupled at a second end to a chamber, the chamber being defined in part by the fuel injector needle valve surface.

14. The needle valve controller of claim 13 wherein a drain orifice is fluidly coupled to the chamber and is further fluidly coupled to a low pressure fuel reservoir.

15. A needle valve controller for use in a fuel injector, the fuel injector having a fuel inlet and a non-fuel actuating fluid inlet, fuel pressure at the inlet being admitted to the fuel injector at a pressure that is less than the pressure required to cause opening of an injector needle valve, the needle valve controller acting in cooperation with an actuating fluid controller disposed in the fuel injector, the actuating fluid controller controlling an injection event by controlling the operation of a fuel intensifier, comprising:

a selectively actuatable timing control valve being in flow communication with a source of intensifier pressurized fuel and being in flow communication with a fuel injector needle valve surface, the timing control valve being shiftable between an open and a closed disposition; a controller operably coupled to the timing control valve for controlling the shifting of the timing control valve between the valve open and closed dispositions, opening the timing control valve acting to port fuel under pressure to the fuel injector needle valve surface, the fuel generating a force on the fuel injector needle valve surface acting to close the fuel injector needle valve without spilling a high pressure fuel ported to the needle valve for injection therefrom, the shifting of the timing control valve being coordinated with, but independent of the actuating fluid controller to control fuel injection to a combustion chamber during the injection event, flow communication with the fuel injector needle valve surface being via a bleed passageway defined in the fuel injector, the bleed passageway being fluidly coupled at a first end to the timing control valve and being fluidly coupled at a second end to a chamber, the chamber being defined in part by the fuel injector needle valve surface a drain orifice is fluidly coupled to the chamber and is further fluidly coupled to a low pressure fuel reservoir, the drain orifice being at all time open to the low pressure fuel reservoir and being sized to throttle a flow of fuel from the chamber.

16. The needle valve controller of claim 15 wherein the diameter of the drain orifice is between 0.1 and 1.0 mm.

17. The needle valve controller of claim 14 wherein the diameter of the drain orifice is substantially 0.5 mm.

18. The needle valve controller of claim 13 wherein a refill passageway fluidly couples the chamber to a low pressure fuel reservoir, fuel in the low pressure fuel reservoir flowing in the refill passageway to refill the chamber.

19. The needle valve controller of claim 18 wherein a check valve is disposed in the refill passageway, the check valve being exposed to the fuel pressure in the low pressure fuel reservoir and in the chamber, opening and closing of the check valve being controlled by the fuel pressure acting thereon.

20. An electronically controlled hydraulically actuated unit injector having a fuel inlet, fuel pressure at the inlet being admitted to the unit injector at a pressure that is less than the pressure required to cause opening of an injector needle valve, comprising:

first and second controllers for cooperatively, independently controlling an injection event;

the first controller being actuated by a non-fuel actuating fluid admitted to the unit injector by an actuating fluid inlet and being in communication with a quantity of fuel in a chamber admitted to the chamber by a fuel inlet, the first controller for affecting the pressure of the fuel in the chamber for initiating and terminating an injection event; and the second controller having a single valve, the single valve being in fluid communication with the fuel chamber and being in selective fluid communication with a controller chamber, the controller chamber being in fluid communication with an injection needle valve and having an open drain orifice, the needle valve being shiftable between a closed position and an open position for effecting fuel injection, the second controller for selectively controlling the opening and closing shifting of the needle valve by means of intensifier pressurized fuel to effect modulation of fuel injection during those injection events wherein such modulation is desired.

21. The fuel injector of claim 20 wherein the first controller opens a window of injection opportunity and the second controller controls the timing and duration of an injection event that occurs within the window of injection opportunity.

22. The fuel injector of claim 21 wherein the first controller opens a window of injection opportunity during which an actuation pressure is made available for use to intensify a fuel pressure.

23. The fuel injector of claim 21 wherein the second controller controls the timing and duration of an injection event that occurs within the window of injection opportunity to define fuel injection parameters.

24. The fuel injector of claim 23 wherein the fuel injection parameters include at least one of the parameters consisting of start of injection, end of injection, interruption of injection, timing of interruption of injection, and duration of interruption of injection, said parameters being attainable while maintaining fuel at the selected relatively high level of pressure to the needle valve.

25. The fuel injector of claim 20 wherein the second controller provides for selective independent control of pilot injection, main injection and rate shaping within a single shot injection event.

26. The fuel injector of claim 20 wherein fuel injection pressure preparation and fuel injection timing control are internally determined and are decoupled.

27. An electronically controlled hydraulically actuated unit injector having a fuel inlet and a needle valve, fuel pressure at the inlet being admitted to the fuel injector at a pressure that is less than the pressure required to cause opening of an injector needle valve, the needle valve being shiftable between an open and a closed position for providing an injection of high pressure fuel during a fuel injection event when in the open position, the injector comprising:

a first controller for initiating and terminating a fuel injection fuel event, the first controller being hydraulically actuated by a non-fuel actuating fluid and acting on fuel admitted to the unit injector at a pressure less than a pressure required to open the needle valve, said first controller causing high pressure fuel to be generated, the high pressure fuel being deliverable to the needle valve during the injection event for injection by the needle valve; and a second controller having a single valve directly controlling a shifting of the needle valve between an open and a closed disposition by means of intensifier pressurized fuel, the second controller selectively controlling the shifting of the needle valve during the injection event to effect modulation of the fuel injection by selectively porting fuel to a controller chamber, the controller chamber being in fluid communication with the needle valve and having an open drain orifice;

the first controller and the second controller being independently actuated for cooperatively defining desired injection characteristics of the fuel injection event, the second controller being actuated only during those injection events when certain injection characteristics other than those achievable by the first controller acting alone are desired.

28. The fuel injector of claim 27 wherein the first controller opens a window of injection opportunity and the second controller controls the timing and duration of an injection event that occurs within the window of injection opportunity.

29. The fuel injector of claim 28 wherein the first controller opens a window of injection opportunity during which an actuation pressure is made available for use to intensify a fuel pressure.

30. The fuel injector of claim 28 wherein the second controller controls the timing and duration of an injection event that occurs within the window of injection opportunity to define fuel injection parameters.

31. The fuel injector of claim 30 wherein the fuel injection parameters include at least one of the parameters being start of injection, end of injection, interruption of injection, timing of interruption of injection, and duration of interruption of injection, said parameters being attainable while maintaining fuel at the selected relatively high level of pressure to the needle valve.

32. The fuel injector of claim 27 wherein the second controller provides for selective independent control of pilot injection, main injection and rate shaping within a single shot injection event.

33. The fuel injector of claim 27 wherein fuel injection pressure preparation and fuel injection timing control are internally determined and are decoupled.

34. An electronically controlled hydraulically actuated unit fuel injector having a fuel inlet and a needle valve, fuel pressure at the inlet being admitted to the fuel injector at a pressure that is less than the pressure required to cause opening of an injector needle valve, the needle valve being shiftable between an open and a closed position, an actuatable actuating fluid control valve for controlling a fuel pressure intensifier to define an injection event, the intensifier acting on a quantity of fuel admitted to the unit injector at a pressure that is less than the pressure required to shift the needle valve to an open disposition to increase the pressure of the quantity of fuel to a pressure at least equal to the pressure required to shift the needle valve to the open disposition, the intensifier being fluidly communicable with the needle valve for providing high pressure fuel substantially continuously for the duration of the injection event, the needle valve injecting a quantity of fuel during a fuel injection event at a known rate of injection as defined by the actuating fluid control valve, comprising:

a needle valve controller being decoupled from the actuating fluid control valve, the needle valve controller having a single valve, the single valve controlling a flow of intensifier pressurized fuel and being in fluid communication with the needle valve for controlling a shifting of the needle valve between an open and a closed position, the control exercised by the needle valve control means providing for the needle valve being shiftable through at least one cycle during the injection event to modify the known rate of injection during selected injection events where such modification is desired independent of the actuating fluid control valve.

35. The fuel injector of claim 34 wherein the actuating fluid control valve opens a window of injection opportunity and the needle valve controller controls the timing and duration of an injection event that occurs within the window of injection opportunity.

36. The fuel injector of claim 35 wherein the actuating fluid controller opens a window of injection opportunity during which an actuation pressure is made available for use to intensify a fuel pressure.

37. The fuel injector of claim 35 wherein the needle valve controller controls the timing and duration of an injection event that occurs within the window of injection opportunity to define fuel injection parameters.

38. The fuel injector of claim 37 wherein the fuel injection parameters include at least one of the parameters being start of injection, end of injection, interruption of injection, timing of interruption of injection, and duration of interruption of injection, said parameters being attainable without resort to spilling fuel form the injector.

39. The fuel injector of claim 34 wherein the needle valve controller provides for selective independent control of pilot injection, main injection and rate shaping within a single shot injection event.

40. The fuel injector of claim 34 wherein fuel injection pressure preparation and fuel injection timing control are internally determined and are decoupled.

41. A method of controlling fuel injection during a fuel injection event in an electronically controlled hydraulically actuated unit fuel injector, the injector having a fuel inlet and a non-fuel actuating fluid inlet, fuel pressure at the inlet being admitted to the fuel injector at a pressure that is less than the pressure required to cause opening of an injector needle valve, both inlets being selectively in fluid communication with a fuel pressure intensifier, having the steps of:

controlling the preparation of fuel pressure for a fuel injection event with a fuel injection pressure control valve;

generating high pressure fuel with the intensifier by means of a non-fuel actuating fluid;

providing high pressure fuel, the high pressure being available to a needle valve substantially continuously for the duration of the fuel injection event; and independently controlling the timing of fuel injection from the needle valve during certain selected fuel injection events with a fuel injection timing controller having a single valve, thereby independently controlling the fuel pressure preparation and the timing of the fuel injection during any selected fuel injection event by means of controlling a flow of intensifier pressurized fuel to a controller chamber, the controller chamber being in fluid communication with the needle valve and having an open drain orifice.

42. The method of claim 41 wherein the preparation of the fuel pressure includes opening a window of injection opportunity and the timing control occurs within the window of injection opportunity.

43. The method of claim 42 including the step of providing an actuation pressure being made available to intensify a fuel pressure.

44. The fuel injector of claim 42 wherein the controlling the timing of a fuel injection event includes the step of defining fuel injection parameters occurring within a single injection event.

45. The method of claim 44 wherein the step of defining fuel injection parameters includes defining at least one of the parameters being start of injection, end of injection, interruption of injection, timing of interruption of injection, and duration of interruption of injection, said parameters being attainable while maintaining fuel at the selected relatively high level of pressure to the needle valve.

46. The method of claim 41 wherein controlling the timing of a fuel injection event provides for selective independent control of pilot injection, main injection and rate shaping within a single shot injection event while maintaining fuel at the selected relatively high level of pressure to the needle valve.

47. The method of claim 41 further comprising the step of supplying the fuel pressure from the fuel injection pressure control valve during the entire injection event.

48. The fuel injector of claim 47 wherein the controlling the timing of a fuel injection event includes the step of defining fuel injection parameters occurring within a single injection event.

49. The method of claim 48 wherein the step of defining fuel injection parameters includes defining at least one of the parameters being start of injection, end of injection, interruption of injection, timing of interruption of injection, and duration of interruption of injection, said parameters being attainable while maintaining fuel at the selected relatively high level of pressure to the needle valve.

50. The method of claim 47 wherein controlling the timing of a fuel injection event provides for selective independent control of pilot injection, main injection and rate shaping within a single shot injection event while maintaining fuel at the selected relatively high level of pressure to the needle valve.

51. The fuel injector of claim 1 wherein preparing fuel pressure and controlling the timing of a fuel injection event are internally determined and are decoupled.

52. A method of operating an electronically controlled hydraulically-actuated fuel injector to achieve a square fuel pressure rate of injection shape during a single injection event, said injector having a non-fuel actuating fluid inlet fluidly coupled to a fuel pressure control valve, the fuel pressure control valve controlling the position of a plunger operatively disposed to pressurize a quantity of fuel in a chamber, the chamber being in fluid communication with a fuel inlet, fuel pressure at the inlet being admitted to the fuel injector at a pressure that is less than the pressure required to cause opening of an injector needle valve, and a needle valve being in fluid communication with said quantity of fuel which may be opened and closed during an injection event, having the sequential steps of:

opening the fuel pressure control valve and moving said plunger to pressurize said quantity of fuel;

independently holding said needle valve in a closed position by means of a single valve shifting to port intensifier pressurized fuel to a controller chamber to act on the needle valve, the controller chamber having an open drain orifice;

after a predetermined duration, independently releasing the pressurized fuel acting on the needle valve;

opening said needle valve to permit injection;

maintaining said needle valve and said control valve open for a predetermined period;

actively closing said needle valve by means of the single valve porting pressurized fuel to act on the needle valve; and closing said fuel pressure control valve.

53. The method of claim 1 further comprising the steps prior to opening said needle valve of bleeding off an initial portion of said quantity of fuel and ending said bleeding after a predetermined travel of said plunger.

54. A method of operating a hydraulically-actuated, electronically controlled fuel injector to achieve pilot injection with a long dwell duration during a single injection event, said injector having a fuel inlet and a fuel pressure control valve, fuel pressure at the inlet being admitted to the fuel injector at a pressure that is less than the pressure required to cause opening of an injector needle valve, the fuel pressure control valve controlling the position of a plunger operatively disposed to pressurize a quantity of fuel and the needle valve associated with said quantity of fuel being opened and closed during an injection event independently of the fuel pressure control valve, comprising:

opening the fuel pressure control valve and moving said plunger to pressurize said quantity of fuel and upon said fuel pressure exceeding a predetermined level, allowing said needle valve to open for a predetermined duration;

closing said needle valve by porting intensifier pressurized fuel to a controller chamber having an open drain orifice, the controller chamber being in fluid communication with the needle valve;

closing said fuel pressure control valve;

within the same injection event, after a predetermined dwell period, again opening the fuel pressure control valve and moving said plunger to pressurize said quantity of fuel allowing said needle valve to open;

maintaining said needle valve and said control valve open for a predetermined period; and again closing said fuel pressure control valve.

55. The method of claim 1 further comprising the step prior to again closing said fuel pressure control valve of closing said needle valve.

56. A method of operating an electronically controlled hydraulically-actuated fuel injector to achieve rate-shaped injection during a single injection event, said injector having a fuel inlet and a non-fuel actuating fluid inlet fluidly coupled to a fuel pressure control valve, fuel pressure at the inlet being admitted to the fuel injector at a pressure that is less than the pressure required to cause opening of an injector needle valve, the fuel pressure control valve controlling the position of a plunger operatively disposed to pressurize a quantity of fuel in a chamber, the chamber being in fluid communication with a fuel inlet, and a needle valve being in fluid communication with said quantity of fuel which may be opened and closed during an injection event, having the steps of:

opening the fuel pressure control valve and moving said plunger to pressurize said quantity of fuel and upon said fuel pressure exceeding a predetermined level, allowing said needle valve to open for a predetermined duration;

with said fuel pressure control valve remaining open and without halting said motion of said plunger while maintaining fuel at the selected relatively high level of pressure to the needle valve, porting intensifier pressurized fuel by a single valve to a controller chamber having an open drain orifice and being in fluid communication with a needle valve surface to affect the needle valve surface for independently at least partially closing said needle valve;

after a very short predetermined dwell period, decreasing the pressure affecting the needle valve surface for independently allowing said needle valve to reopen;

maintaining said needle valve and said control valve open for a predetermined period; and closing said fuel pressure control valve.

57. A hydraulically actuated, electronically controlled fuel injector being fluidly coupled to a source of low pressure fuel, fuel pressure being admitted to the fuel injector at a pressure that is less than the pressure required to cause opening of an injector needle valve, and having a fuel pressure intensifier, the fuel intensifier hydraulically amplifying the fuel pressure for injection at a relatively high pressure, comprising:

a fuel injection pressure control valve for preparing fuel pressure; being in flow communication with a source of pressurized non-fuel actuating fluid and selectively porting such actuating fluid to the fuel intensifier for hydraulic amplification of the fuel pressure; and a fuel injection timing control valve for controlling the timing of a fuel injection event by controlling a flow of intensifier pressurized fuel to a controller chamber, the controller chamber having an open drain orifice and being in fluid communication with the injector needle valve, the fuel injection pressure control valve and the fuel injection timing control valve being independently controllable.

58. The fuel injector of claim 57 wherein the fuel injection pressure control valve opens a window of injection opportunity and the fuel injection timing control valve controls the timing and duration of an injection event that occurs within the window of injection opportunity.

59. The fuel injector of claim 58 wherein the fuel injection pressure control valve opens a window of injection opportunity during which an actuation pressure is made available for use to intensify a fuel pressure.

60. The fuel injector of claim 58 wherein the fuel injection timing control valve controls the timing and duration of an injection event that occurs within the window of injection opportunity to define fuel injection parameters.

61. The fuel injector of claim 60 wherein the fuel injection parameters occurring within an injection event include at least one of the parameters being start of injection, end of injection, interruption of injection, timing of interruption of injection, and duration of interruption of injection.

62. The fuel injector of claim 57 wherein the fuel injection timing control valve provides for selective independent control of pilot injection, main injection and rate shaping within a single shot injection event.

63. The fuel injector of claim 57 wherein fuel injection pressure preparation and fuel injection timing control are internally determined and are decoupled.

64. The fuel injector of claim 57 wherein the fuel injection timing control valve has relatively less flow area in relation to the fuel injection pressure control valve, the lesser flow area enhancing the response time of the fuel injection timing control valve for improving the shaping of the injection event as desired.

65. The fuel injector of claim 57 wherein a full actuation pressure is available from the fuel injection pressure control valve for the duration of an injection event, thereby providing maximum injection pressure throughout the injection event without regard to shaping of the injection event as desired.

66. The fuel injector of claim 57 wherein the fuel injection pressure control valve for preparing fuel pressure is cycled opened and closed a single time during each injection event and the fuel injection timing control valve may be independently cycled opened and closed a plurality of cycles during single time during each injection event for effecting shaping of the injection event as desired.

67. A hydraulically actuated, electronically controlled unit injector having an inlet for admitting non-fuel actuating fluid to the injector and a fuel inlet for admitting a quantity of fuel at a pressure that is less than a pressure necessary to open a needle valve to cause fuel injection, an intensifier for selectively pressurizing the quantity of fuel to a pressure sufficient to open the needle valve when the intensifier is acted upon the actuating fluid, the pressurized fuel being available for control of the needle valve continuously during an injection event, the unit injector comprising:

a timing controller in fluid communication with the needle valve and with the intensifier, the timing controller being decoupled from actuation of the intensifier and controlling the shifting of the valve between an open and a closed disposition during an injection event by controlling a flow of pressurized fuel from the intensifier to a controller chamber having an open drain orifice, the controller chamber being in fluid communication with the needle valve.

68. The hydraulically actuated, electronically controlled unit injector of claim 67 wherein the timing controller directly controls the shifting of the needle valve.

69. The hydraulically actuated, electronically controlled unit injector of claim 68 wherein the timing controller directly controls the shifting of the needle valve by selectively porting a flow of pressurized fuel to exert a force on a needle valve surface, the force acting bias the needle valve in a closed disposition.

70. The hydraulically actuated, electronically controlled unit injector of claim 67 wherein the timing controller includes an electronically actuated controller valve, the controller valve being in fluid communication with a fuel passage extending between the intensifier and the needle valve, the fuel passage conveying high pressure fuel.

71. The hydraulically actuated, electronically controlled unit injector of claim 70 wherein the controller valve is in fluid communication with a controller chamber, the controller chamber being defined in part by a needle valve surface, the timing controller porting high pressure fuel to the needle valve surface when the controller valve is in an open disposition.

72. The hydraulically actuated, electronically controlled unit injector of claim 71 wherein the controller chamber is in fluid communication with a fuel reservoir via a fuel refill passage, the controller chamber being refilled with fuel when the controller valve is in a closed disposition.

73. A hydraulically actuated, electronically controlled unit injector having an inlet for admitting non-fuel actuating fluid to the injector and a fuel inlet for admitting a quantity of fuel at a pressure that is less than a pressure necessary to open a needle valve to cause fuel injection, an intensifier for selectively pressurizing the quantity of fuel to a pressure sufficient to open the needle valve when the intensifier is acted upon the actuating fluid, the pressurized fuel being available for control of the needle valve continuously during an injection event, the unit injector comprising:

a timing controller in fluid communication with the needle valve and with the intensifier being decoupled from actuation of the intensifier and controlling the shifting of the valve between an open and a closed disposition during an injection event by controlling a flow of pressurized fuel from the intensifier to the needle valve, the timing controller including an electronically actuated controller valve, the controller valve being in fluid communication with a fuel passage extending between the intensifier and the needle valve, the fuel passage conveying high pressure fuel, the controller chamber is in fluid communication with a fuel reservoir via a fuel refill passage, the controller chamber being refilled with fuel when the controller valve is in a closed disposition, the controller chamber being further in fluid communication with the fuel reservoir via a drain orifice, the drain orifice being open at all times.

* * * * *